US005606330A

United States Patent [19]

Wood et al.

[11] Patent Number: 5,606,330

[45] Date of Patent: Feb. 25, 1997

[54] SUBMARINE ANTENNA POSITIONING ASSEMBLY

[75] Inventors: Edwin H. Wood, North Franklin; William E. Swanson, North Stonington, Conn.

[73] Assignee: The United States of America as represented by the Secretary of the Navy, Washington, D.C.

[21] Appl. No.: 443,912

[22] Filed: May 22, 1995

[51] Int. Cl.[6] ..... H01Q 3/00

[52] U.S. Cl. ..... 343/766; 343/719; 343/763; 343/882; 343/883; 343/889

[58] Field of Search ..... 343/719, 714, 343/763, 765, 766, 882, 883, 888, 889, 890; 248/669; 254/DIG. 4, 7 C, 30, 85, 98

[56] References Cited

U.S. PATENT DOCUMENTS

| | | | |
|---|---|---|---|
| 2,166,589 | 7/1939 | Harrington | 343/714 |
| 2,991,966 | 7/1961 | Varel | 248/669 |
| 3,042,372 | 7/1962 | Zeigler | 254/7 C |
| 3,495,261 | 2/1970 | Lastinger et al. | 343/883 |
| 3,620,503 | 11/1971 | Bro | 254/30 |
| 4,295,621 | 10/1981 | Siryj | 343/765 X |
| 4,669,943 | 6/1987 | Zamotin | 254/98 X |

*Primary Examiner*—Donald T. Hajec
*Assistant Examiner*—Tho Phan
*Attorney, Agent, or Firm*—Michael J. McGowan; Prithvi C. Lall; Michael F. Oglo

[57] ABSTRACT

There is presented an antenna assembly comprising an elongated mast slidably mounted in a support structure. A first electric motor is disposed at a proximal end of the mast for moving the mast along the axis of the mast, and a second electric motor is disposed at a distal end of the mast for moving the mast rotatively about its axis.

5 Claims, 2 Drawing Sheets

SUBMARINE ANTENNA POSITIONING ASSEMBLY

STATEMENT OF GOVERNMENT INTEREST

The invention described herein may be manufactured and used by or for the Government of the United States of America for governmental purposes without the payment of royalties thereon or therefor.

BACKGROUND OF THE INVENTION (1) Field of the Invention

This invention relates to antenna assemblies and is directed more particularly to an assembly including means for moving the antenna along its axis and rotatively about its axis.

(2) Description of the Prior Art

Submarine radar antenna operating mechanisms are located within and protrude through the top of the bridge access trunk of the submarine. The mechanisms, as presently constituted, require space which, in turn, requires an enlarged access trunk structure which adds considerable weight to the sail area of the submarine, well above the center of gravity of the boat.

The mechanism, as presently constituted, includes a large and heavy motor and reduction gear assembly for inside the bridge access trunk. For raising and lowering of the antenna, there is a hydraulic actuator inside the sail, which is outside the pressure hull. On several occasions, leakage of hydraulic fluid in the hydraulic raising and lowering system has led to gradual raising of the antenna, or "creep" which has caused the antenna to extend into the underwater environment, causing the antenna to be torn from its foundation during submerged submarine maneuvers. The location of the hydraulic mechanism for raising and lowering the antenna requires that hydraulic fluid be supplied to the sail area.

There is a need for a relatively light weight antenna assembly requiring less space and therefore less structural weight in the sail area of a submarine. There is further a need for such an assembly as does not require a supply of hydraulic fluid to the sail area and is not subject to "creep". There is also a need for a non-hull-penetrating mast, in order to divorce the antenna position in the sail from the hull arrangement.

SUMMARY OF THE INVENTION

An object of the invention is, therefore, to provide an antenna assembly which is of lighter weight than current assemblies used to move submarine radar antennas.

A further object is to provide such an assembly which requires substantially less space than present assemblies, thereby reducing substantially the structural steel requirement for housing and mounting the assembly.

A still further object is to provide such an assembly which requires no hydraulic system for operation and therefore no supply of hydraulic fluid to the sail area, and is not subject to "creep".

A still further objective is to provide such an assembly which is locationally independent of the pressure hull.

With the above and other objects in view, as will hereinafter appear, a feature of the present invention is the provision of an antenna assembly comprising an elongated mast slidably mounted in a support structure. A first motor is disposed at a proximal end of the mast for moving the mast along the axis of the mast, and a second motor is disposed at a distal end of the mast for moving the mast rotatively about the axis of the mast.

The above and other features of the invention, including various novel details of construction and combinations of parts, will now be more particularly described with reference to the accompanying drawings and pointed out in the claims. It will be understood that the particular assembly embodying the invention is shown by way of illustration only and not as a limitation of the invention. The principles and features of the invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent. In the drawings.

DESCRIPTION OF THE PREFERRED EMBODIMENT

Figure 1:
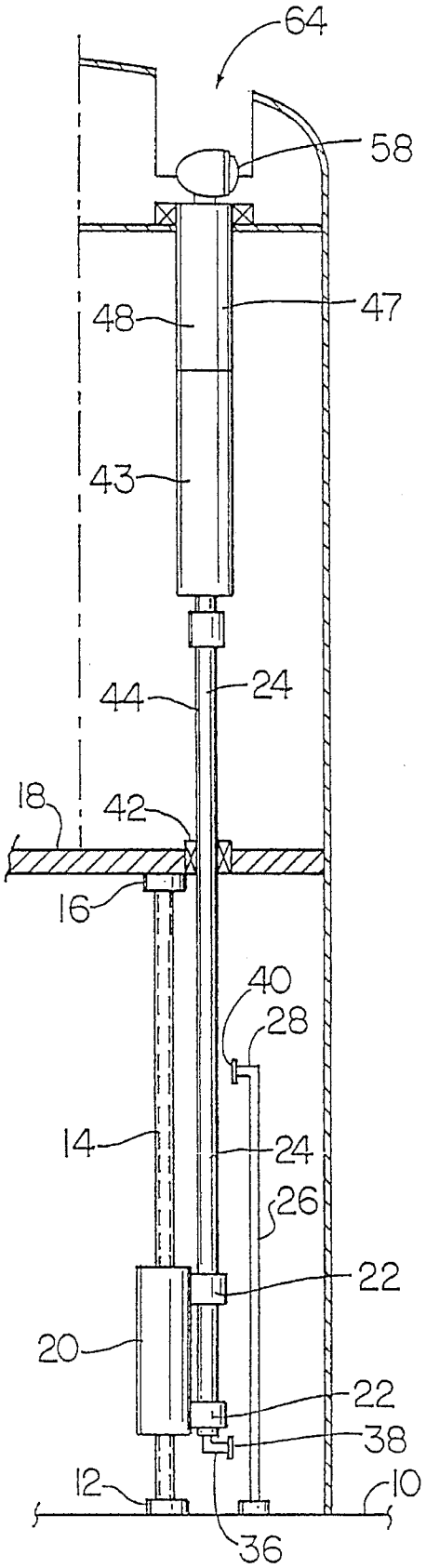
FIG. 1 is a side elevational view of an antenna assembly, illustrative of an embodiment of the invention, shown in a forward portion of a submarine sail, or conning tower.
Figure 2:
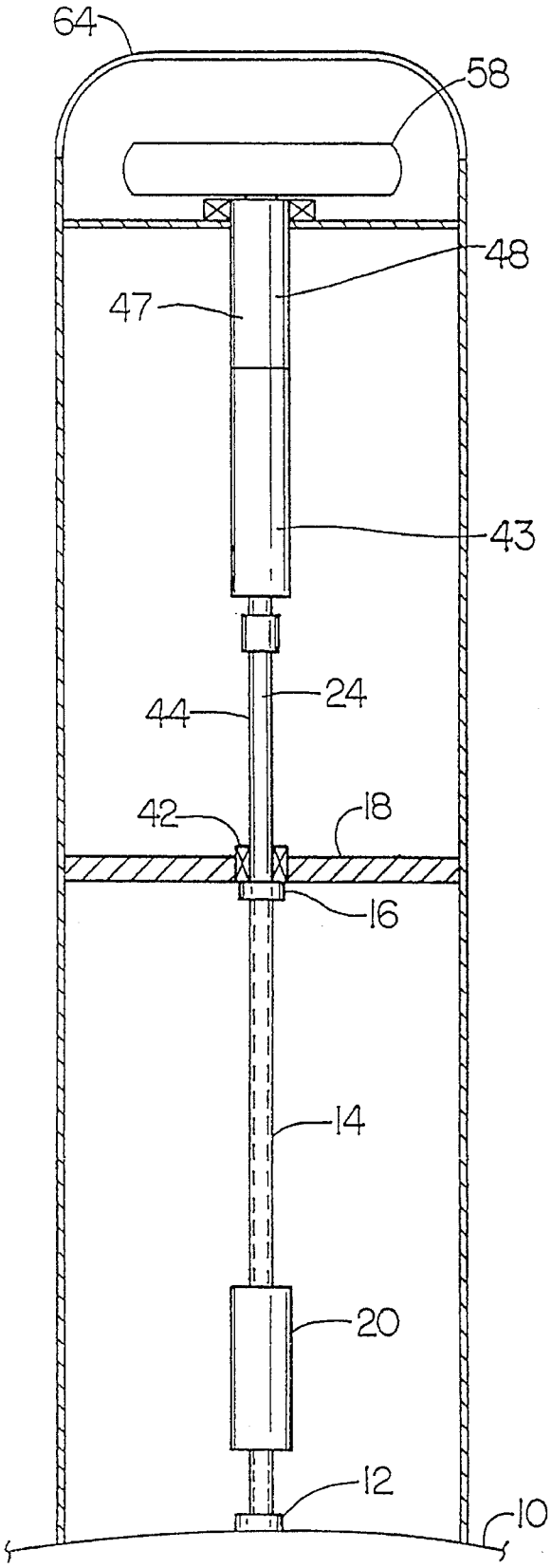
FIG. 2 is a rear elevational view of the antenna assembly of FIG. 1, looking forward into the forward bulkhead of the sail.

Referring to FIGS. 1 and 2, it will be seen that fixed to a submarine pressure hull portion 10 is a first bracket 12 for retaining one end of a threaded shaft 14. A second bracket 16 is fixed to an underside of a horizontal structural member 18 for retaining the other end of threaded shaft 14. The brackets 12, 16 hold threaded shaft 14 in a fixed, non-rotatable fashion.

Mounted on threaded shaft 14 is a first electric motor 20 wherein a stator portion (not shown) is stationary, and disposed concentrically therein is a rotor portion (not shown) rotatably driven by the stator, as is known in the art. The rotor constitutes a threaded sleeve (not shown) rotatable within the stator and threadably engaged with shaft 14. Energization of first motor 20 causes rotation of the rotor portion of the motor, which causes the motor to move along threaded shaft 14.

Fixed to first motor 20, as by clamps 22, is an elongated antenna mast 24. Thus, movement of first motors 20 along threaded shaft 14 carries with it movement of mast 24 axially of the mast.

Figure 4:
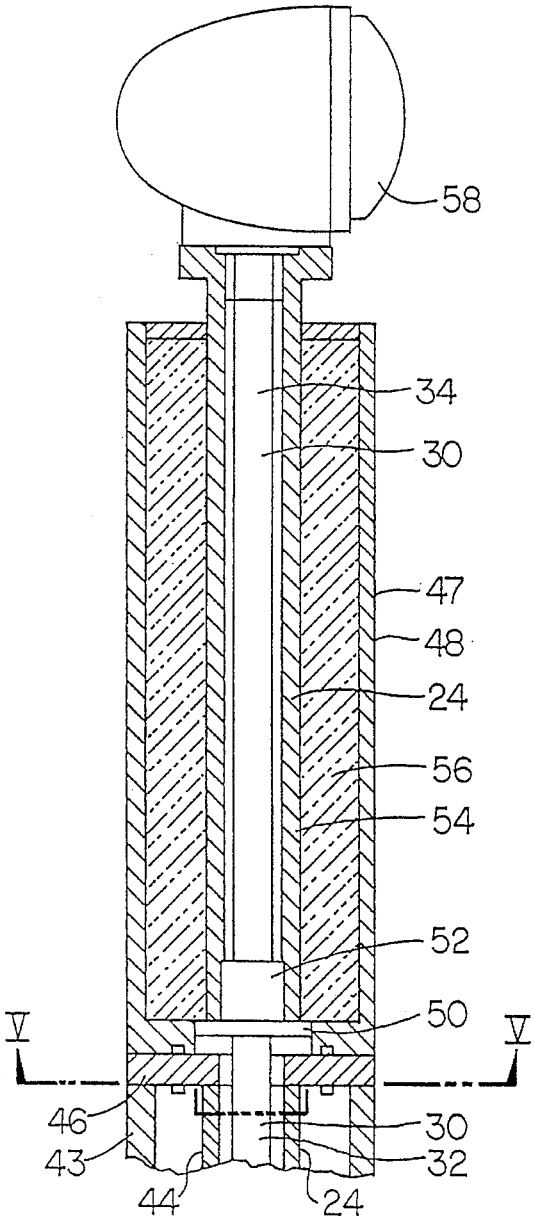
FIG. 4 is a sectional view of a motor for imparting rotative movement to a mast portion of the assembly.

A vertical wave guide 26 is fixed to pressure hull 10 and is provided at an upper end thereof with a 90° bend, such that an end portion 28 of fixed wave guide 26 is substantially parallel to the portion of pressure hull 10 on which wave guide 26 is mounted. Within mast 24, there is disposed a moveable wave guide 30, including a lower portion 32 and an upper portion 34 (FIG. 4). At the lower end of lower portion 32 of moveable wave guide 30, the wave guide is bent 90° to provide an end portion 36 normal to the remainder of moveable wave guide lower portion 32. An open end 38 of moveable wave guide end portion 36 is adapted to engage precisely an open end 40 of fixed wave guide end portion 28.

A bearing assembly 42 accommodates sliding movement of mast 24 through structural member 18. The mast 24 includes an enlarged portion 43. Referring to FIG. 4, it will be seen that at the upper end of mast enlarged portion 43 there is fixed to an upper end of a lower portion 44 of mast 24 a flange 46, which is connected to a lower end of a housing 47 for a second motor 48. Fixed to the upper end of the lower portion 32 of moveable wave guide 30 is a circular plate 50. On the lower end of upper portion 34 of wave guide 30 is an enlarged portion 52 bearing against an upper surface of circular plate 50 and fixed to an upper portion 54 of mast 24. The enlarged portion 52 serves as a wave guide rotary coupling connecting the rotating upper portion 34 to the non-rotating lower portion 32. The upper portion 54 of mast 24 is a motor rotor portion driven by a motor stator portion 56. As the mast upper portion 54 rotates about its axis, rotatively carried thereby, through the wave guide enlarged portion 52, is the moveable wave guide upper portion 34.

Thus, as the mast 24 moves upwardly, the mast enlarged portion 43 and the second motor 48, supported thereon, move with the mast 24. However, upon energization of second motor 48, only mast upper portion 54 rotates with the upper portion 34 of wave guide 30 rotating therewith. The outer housing 47 of second motor 48 is fixed to the mast enlarged portion 43 of mast 24, and stator portion 56 of second motor 48 is fixed to motor housing 47. The enlarged portion 52 of the upper wave guide 34 is free to turn on the plate 50.

Figure 5:
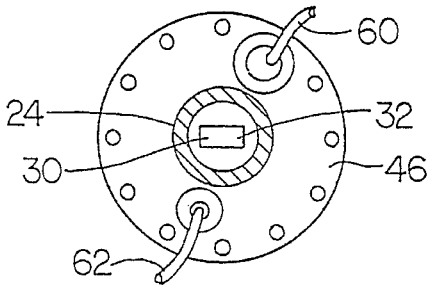
FIG. 5 is a sectional view taken along line V—V of FIG. 4.

The first and second motors 20, 48 are both brushless D.C. electric motors having rotatable components which serve as direct drive mechanisms for the mast 24. The first motor moves the entire mast axially of the mast, and the second motor rotates the upper portion 54 of the mast to rotate a radar antenna 58 fixed to a top end of the mast. Both motors are provided with power leads 60 and control leads 62, illustrated in FIG. 5. Typically, the motors are of only eight inch outside diameter.

Figure 3:
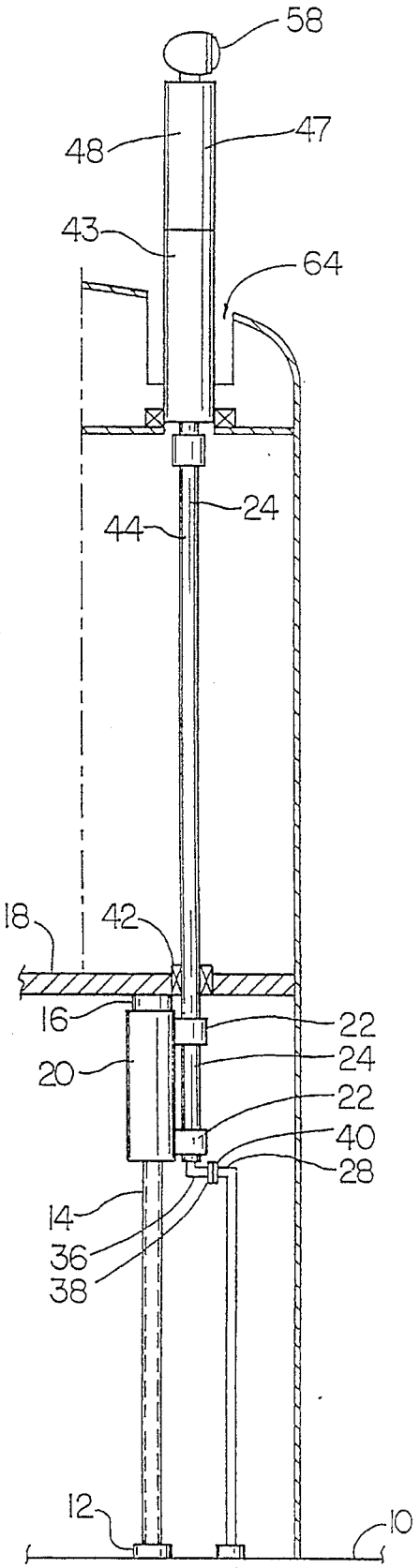
FIG. 3 is similar to FIG. 1, but showing the assembly with the mast portion raised.

In operation, to raise radar antenna 58, first motor 20 is activated and thereby caused to travel up threaded shaft 14. As first motor 20 moves upwardly, so does antenna mast 24, which is fixed to the motor. As antenna mast 24 travels upwardly, carried with mast 24 is wave guide end 36. When first motor 20 reaches its uppermost position, as shown in FIG. 3, the open end 38 of moveable waveguide end portion 36 aligns precisely with, and engages with, open end 40 of fixed wave guide end portion 28.

Raising of antenna mast lower portion 44 is accompanied by corresponding raising of antenna mast upper portion 54, the upper portion 34 of moveable wave guide 30, mast enlarged portion 43, second motor 48, and radar antenna 58, the latter emerging through an opening 64 in the top of the sail, or conning tower.

Selected activation of second motor 48 operates to rotate upper mast portion 54, upper moveable wave guide portion 34, and radar antenna 58, to a selected azimuth.

By reactivating first motor 20, the antenna mast 24 may be lowered back to the position seen in FIG. 1.

There is thus provided an antenna assembly requiring relatively little space, including relatively small, lightweight motors and other components, requiring no hydraulic system and therefore free of "creep". The assembly can be disposed outside the pressure hull and outside the bridge access trunk, thereby reducing the need for a large access trunk and the need for accompanying structural steel and locational dependence on the pressure hull.

It is to be understood that the present invention is by no means limited to the particular construction herein disclosed and/or shown in the drawings, but also comprises any modifications or equivalents within the scope of the claims.

What is claimed is:

1. An antenna assembly comprising:

an elongated mast slidably mounted in a support structure;

a first rotary electric motor disposed at a proximal end of said mast for moving said mast along the axis of said mast; and a second rotary electric motor disposed at a distal end of said mast for moving said mast rotatively about said axis;

a stator portion of said first motor being fixed to said mast at said proximal end, and a rotor portion of said first motor being moveable along a shaft parallel to said mast, movement of said first motor rotor portion along said shaft causing corresponding movement of said first motor rotor portion and said mast along said axis;

said shaft extending through the center of said first motor rotor portion; and said mast extending through the center of said second motor and comprising a rotatable motor rotor portion of said second motor.

2. An antenna assembly comprising:

an elongated mast slidably mounted in a support structure;

a first motor disposed at a proximal end of said mast for moving said mast along the axis of said mast; and a second motor disposed at a distal end of said mast for moving said mast rotatively about said axis;

wherein said first motor is fixed to said mast at said proximal end and is moveable along a shaft parallel to said mast, movement of said first motor along said shaft causing corresponding movement of said mast along said axis, said shaft extending through the center of said first motor; and wherein said mast extends through the center of said second motor and comprises a rotatable portion of said second motor, a stationary portion of said second motor comprising a stator portion of said second motor fixed to a non-rotatable mast outer housing member.

3. An antenna assembly comprising:

an elongated mast slidably mounted in a support structure and comprising an upper mast portion and a lower mast portion;

a threaded shaft fixed to said support structure and extending a parallel to said lower mast portion;

a first motor mounted on said threaded shaft and fixed to said lower mast portion, said motor being adapted to move along said threaded shaft and to cause corresponding axial movement of said lower mast portion, said upper mast portion being moveable axially with said lower mast portion;

a second motor mounted on said upper mast portion, said upper mast portion comprising a rotatable portion of said second motor, said upper mast portion being rotatable independently of said lower mast portion;

a radar antenna mounted on a distal end of said upper mast portion;

a stationary wave guide having an open end facing said lower mast portion; and a moveable wave guide disposed in said elongated mast and comprising upper and lower wave guide portions, said lower wave guide portion having an open end for alignment with and engagement with said stationary wave guide opening when said elongated mast is fully extended.

4. The assembly in accordance with claim 3 wherein said upper wave guide is fixed within said upper mast portion, whereby rotation of said upper mast portion is accompanied by corresponding rotation of said upper wave guide.

5. The assembly in accordance with claim 4 wherein said lower wave guide is disposed in said lower mast portion and is non-rotatable.

* * * * *